United States Patent [19]

Warnod

[11] 4,234,873

[45] Nov. 18, 1980

[54] ALARM INSTALLATION WITH A NUMBER OF SELF POWERED INDICATING ELEMENTS

[75] Inventor: Bertrand A. Warnod, Neuilly-sur-Seine, France

[73] Assignee: Klaxon S.A., Courbevoie, France

[21] Appl. No.: 897,085

[22] Filed: Apr. 17, 1978

[30] Foreign Application Priority Data

May 4, 1977 [FR] France ..... 77 13793

[51] Int. Cl.[3] ..... G08B 29/00

[52] U.S. Cl. ..... 340/509; 340/506; 340/510; 340/515; 340/292

[58] Field of Search ..... 340/509, 510, 636, 515, 340/506, 568, 574, 572, 541, 292

[56] References Cited

U.S. PATENT DOCUMENTS

| | | | |
|---|---|---|---|
| 1,084,059 | 1/1914 | Beach | 340/292 |
| 3,060,416 | 10/1962 | Brown | 340/509 |
| 3,135,951 | 6/1964 | Byrne | 340/509 |
| 3,461,443 | 8/1969 | Vasel | 340/509 |
| 3,594,751 | 7/1971 | Ogden et al. | 340/636 |
| 3,764,971 | 10/1973 | Brobeck | 340/568 |

*Primary Examiner*—Glen R. Swann, III

*Attorney, Agent, or Firm*—James C. Wray

[57] ABSTRACT

An alarm system includes a number of self powered indicating elements each with an integral warning device. Each indicating element includes a control circuit which may comprise a transistor switching circuit, transistor oscillator or part of a wheatstone bridge circuit for example. Each of these control circuits is connected via two lines to a common control element at a position remote from the remainder of the control circuit, such element comprising for example a resistor, a battery or a zener diode dependent on the type of control circuit utilized. A switch is also included to provide, on actuation, either a short circuit or open circuit condition between the two lines. Actuation of this switch or tampering with the lines so as to cause a short circuit or open circuit condition to occur will result in operation of the alarm.

6 Claims, 4 Drawing Figures

ALARM INSTALLATION WITH A NUMBER OF SELF POWERED INDICATING ELEMENTS

BACKGROUND TO THE DISCLOSURE

The invention relates to an alarm installation with self-powered indicating elements. The elements can for example be self-contained sound units.

Such installations are known which comprise a plurality of elements disposed at different locations and controlled simultaneously from an external supply source. The principal drawback of such an installation resides in that it necessitates great precautions concerning the common power source and the control line.

OBJECT OF THE INVENTION

The present invention aims at not rendering essential the use of an external source, by using a watching current constituted by the sum of portions of source current of each self-supplied element.

SUMMARY OF INVENTION

According to the invention I provide an indicating system comprising at least one indicating element including a warning device, and a supply source, the provision of a first control circuit connected between the source and the warning device, a second control circuit forming with said first control circuit a control member for said indicating element and a switch mechanism connected between said second control circuit and said first control circuit, said mechanism being operable to effect at least one of the conditions of short circuit of said second control circuit, open-circuit between the first control circuit and the second control circuit, and both the aforesaid short circuit and open circuit conditions.

BRIEF DESCRIPTION OF DRAWINGS

The invention will be clearly understood on reading of the following description given with reference to the accompanying drawing, wherein.

DESCRIPTION OF PREFERRED EMBODIMENT

Figure 1:
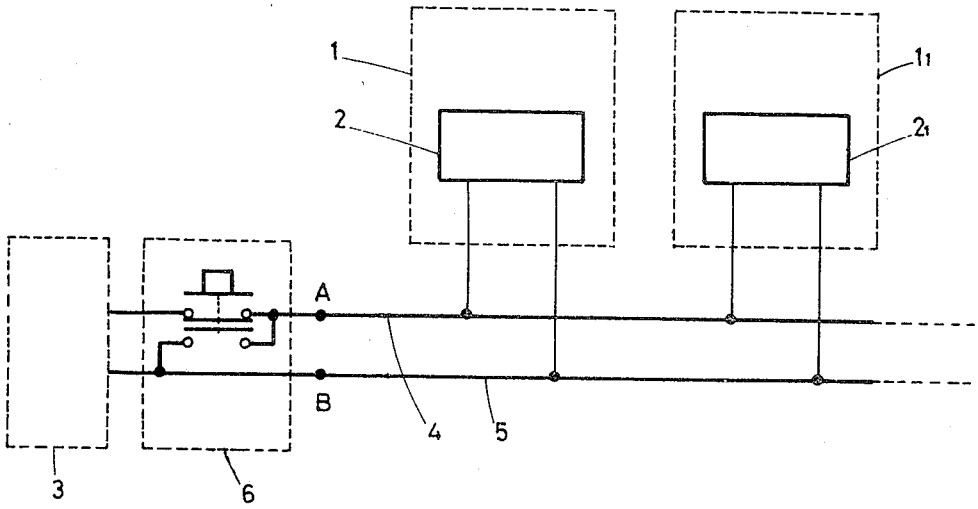
FIG. 1 is a diagram of principle of an installation according to the invention.

The installation according to the invention is constituted by a plurality of self-powered indicating elements 1, $\mathbf{1}_1 \ldots \mathbf{1}_n$, each comprising at least one indicating device such as an audible alarm and a supply source (not shown).

According to the invention a unit 2, $\mathbf{2}_1 \ldots \mathbf{2}_n$ is mounted in each element 1 between the self-contained supply source and the warning device, this unit forming the first part of a control device of the warning device, the second part 3 of which is common to the various elements 1, $\mathbf{1}_1 \ldots \mathbf{1}_n$. The part 3 is connected to each of the units 2, $\mathbf{2}_1 \ldots \mathbf{2}_n$ through the intermediary of common lines 4 and 5, between which there is disposed an alarm actuation device 6 simultaneously effecting the disconnection and short-circuiting of the part 3.

When the device 6 is not actuated (position as represented) the various control members 2–3, $\mathbf{2}_1$–3 . . . $\mathbf{2}_n$–3 are correctly connected and do not operate their respective warning devices. In the case of actuation of the device 6, cutting off at a point such as A or B of the lines 4 or 5, or short-circuit between two points of the lines 4 and 5 such as A and B, the part 3 of the control members 2–3, $\mathbf{2}_1$–3, . . . $\mathbf{2}_n$–3 is isolated and these members cause the operation of their respective warning devices.

Figure 2:
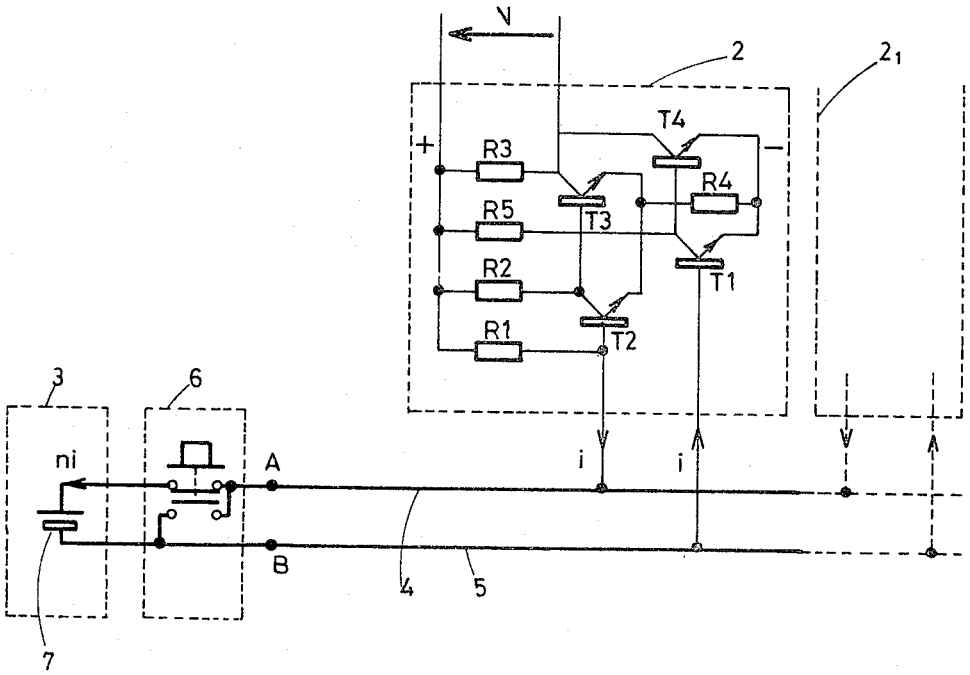
FIG. 2 is a diagram of an installation according to one example of realisation of the invention.

In the form of embodiment according to FIG. 2, the part 3 is constituted by a cell 7 connected in opposition to the source in the elements 1. Each unit 2, $\mathbf{2}_1 \ldots \mathbf{2}_n$ comprises two transistors $T_1$ and $T_2$ the bases of which are connected respectively to the lines 5 and 4. The base and the collector of the transistor $T_2$ are connected to the positive terminal of the self-contained supply of the element through the intermediary of resistors $R_1$ and $R_2$ respectively; the collector of the transistor $T_2$ is further connected to the base of a transistor $T_3$ the collector of which is connected to the positive terminal through the intermediary of a resistor $R_3$. The emitters of the transistors $T_2$ and $T_3$ are connected to one another and are further united at the negative terminal of the self-contained supply through the intermediary of a common resistor $R_4$.

The emitter of the transistor $T_1$ is connected to the negative terminal of the self-contained source while its collector is connected to the positive terminal through the intermediary of a resistor $R_5$. This collector is further connected to the base of a transistor $T_4$ the emitter of which is connected to the negative terminal of the self-contained source. The collector of the transistor $T_4$ is connected to that of the transistor $T_3$. The voltage v available between the positive terminal of the self-contained source and a point common to the circuits of the collectors of the transistors $T_3$ and $T_4$ is utilised to operate the warning device of the element 1.

Each element 1, $\mathbf{1}_1 \ldots \mathbf{1}_n$ generates a current i which passes through the cell 7 and the base-emitter junction of the transistor $T_1$. This transistor $T_1$ is saturated. The same is true of the transistor $T_2$ the base of which is at a potential higher than that of the emitter, so that the transistors $T_3$ and $T_4$ are blocked. The voltage v is close to zero and the warning device is not supplied.

In the case of a short-circuit between the points A and B, the potential difference between these points becomes zero, which blocks the transistor $T_2$ and saturates the transistor $T_3$. The voltage v becomes sufficient to actuate the warning device, whatever is the state of the transistor $T_4$.

In the case of cutting of the line 4 or the line 5 at a point such as A or B respectively, the transistor $T_1$ blocks and the transistor $T_4$ becomes saturated. The voltage v becomes sufficient to actuate the warning device, whatever is the state of the transistor $T_3$.

In the case of a short circuit and a simultaneous cut-off, which occur in particular when the device 6 is actuated, the transistors $T_3$ and $T_4$ are saturated and the voltage v becomes sufficient to actuate the warning device.

The cell 7 is in fact a member creating a back electromotive force. It can be replaced by any member having the same function, such as an accumulator battery mounted in opposition, a Zener diode or resistor. In this latter case the resistance value must be calculated as a function of the number n of elements so as to ensure the potential difference necessary for operation.

Figure 3:
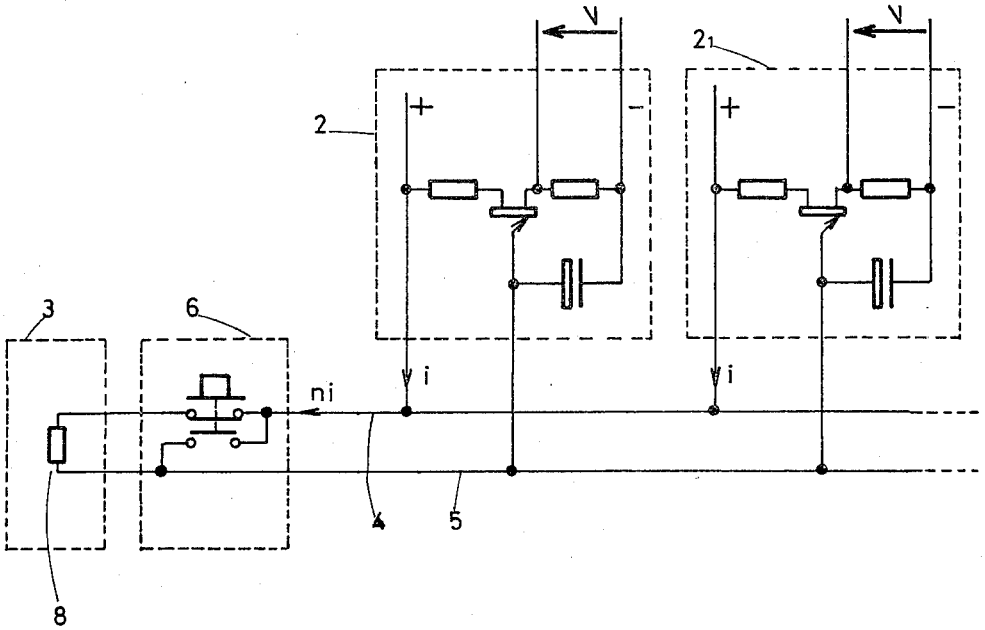
FIGS. 3 and 4 are diagrams of variants of the installation according to the invention.

In the form of embodiment according to FIG. 3, the units 2, $\mathbf{2}_1 \ldots \mathbf{2}_n$ are constituted each by a part of a control oscillator and the part 3 common to the oscillators is a resistor 8.

Figure 4:
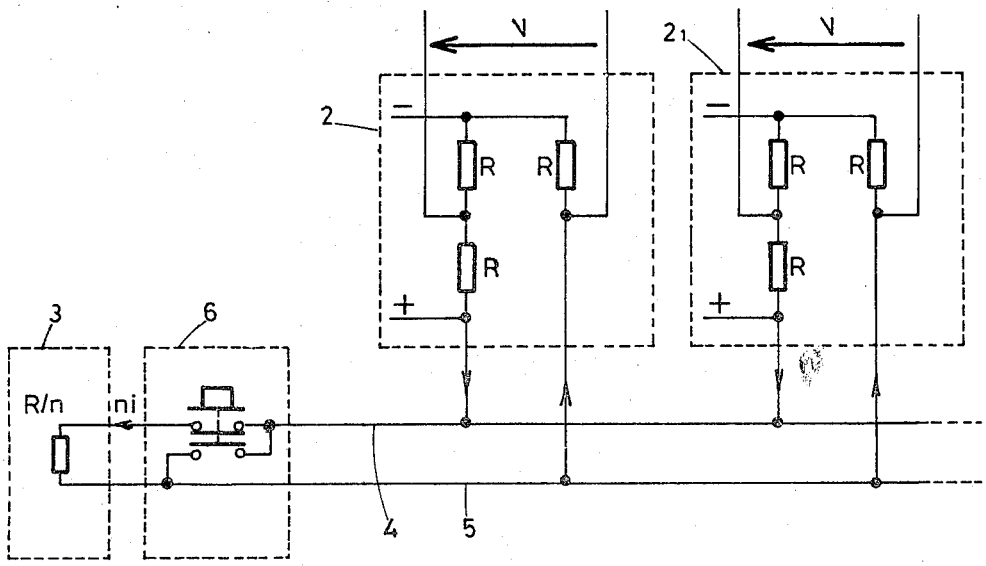

In the form of embodiment according to FIG. 4, the units 2, $2_1$ . . . $2_n$ are constituted each by a part of a Wheatstone bridge constituted by three resistors of value R and the part 3 common to the n bridges is a resistor of value R/n.

I claim:

1. In an alarm system comprising a plurality of indicating elements each including a warning device and an independent power supply source, the provision of (a) a first control circuit for each respective element connected between the source and the warning device to control the operation thereof;

(b) coupling means comprising a pair of wires connected to the first control circuit of each indicating element to form a pair of common connections in parallel therebetween;

(c) a second control circuit between the pair of wires forming said coupling means at a position remote from said first control circuits connected with each said first control circuit via said coupling means to form a common control for each said indicating element capable of maintaining a potential difference between the pair of wires of said coupling means, and (d) a switch mechanism for actuating said alarm connected between said common second control circuit and each said first control circuit via said coupling means, said mechanism being operable to effect at least one of the conditions of short circuit of said second control circuit, open-circuit between the first control circuit and the second control circuit, and both the aforesaid short circuit and open circuit conditions causing a change in circuit conditions normally dependent on said second control circuit, to effect operation of said alarm when an open circuit or short circuit condition occurs.

2. An alarm system according to claim 1, wherein the said second control circuit is constituted by a device creating a potential difference.

3. An alarm system according to claim 2, wherein the second control circuit is a cell connected in opposition to the source in said indicating element.

4. An alarm system according to claim 2, wherein the first control circuit comprises two pairs of transistors supplied respectively by the current derived from the self-contained source of the corresponding element and the current deriving from the said device creating a potential difference.

5. An alarm system according to claim 1, wherein the second control circuit is a resistor.

6. An alarm system according to claim 1, wherein the first control circuit is a portion of a Wheatstone bridge and the said second control circuit is a resistor completing said Wheatstone bridge.

* * * * *